US009783401B2

(12) United States Patent
Cavazza et al.

(10) Patent No.: US 9,783,401 B2
(45) Date of Patent: Oct. 10, 2017

(54) FILLING APPARATUS FOR FILLING CONTAINERS AND RELATED METHOD

(71) Applicant: G.D SOCIETA' PER AZIONI, Bologna (IT)

(72) Inventors: Luca Cavazza, Bologna (IT); Umberto Zanetti, Modena (IT); Andrea Biondi, Bologna (IT)

(73) Assignee: GD SOCIETA' PER AZIONI, Bologna (IT)

( * ) Notice: Subject to any disclaimer, the term of this patent is extended or adjusted under 35 U.S.C. 154(b) by 45 days.

(21) Appl. No.: 15/050,702

(22) Filed: Feb. 23, 2016

(65) Prior Publication Data

US 2016/0244310 A1 Aug. 25, 2016

(30) Foreign Application Priority Data

Feb. 24, 2015 (IT) ..... BO2015A0092

(51) Int. Cl.

| | |
|---|---|
| ***B67C 3/22*** | (2006.01) |
| ***B67C 3/02*** | (2006.01) |
| ***B67C 3/00*** | (2006.01) |
| ***B67C 7/00*** | (2006.01) |

(52) U.S. Cl.

CPC ..... *B67C 3/02* (2013.01); *B67C 3/001* (2013.01); *B67C 3/22* (2013.01); *B67C 7/00* (2013.01); *B67C 2007/006* (2013.01)

(58) Field of Classification Search

CPC .. B67C 3/02; B67C 3/22; B67C 3/001; B67C 7/00; B67C 2007/006

See application file for complete search history.

(56) References Cited

U.S. PATENT DOCUMENTS 6,179,017 B1 1/2001 Walter
7,114,535 B2 * 10/2006 Hartness ..... B67C 3/02 141/1
7,165,582 B2 * 1/2007 Till ..... B67C 7/0086 141/144

(Continued)

FOREIGN PATENT DOCUMENTS

EP 1 028 057 A2 8/2000
EP 1 103 515 A1 5/2001

OTHER PUBLICATIONS

Italian Search Report, Italian patent application No. BO20150092 dated Oct. 12, 2015.

*Primary Examiner* — Nicolas A Arnett
(74) *Attorney, Agent, or Firm* — Marshall, Gerstein & Borun LLP

(57) ABSTRACT

The present invention relates to a filling apparatus for filling containers with fluid products, and to the respective method, wherein the apparatus comprises a rest area arranged outside of a filling path and of a filling area, the rest area is accessible to the operator without interrupting the filling of the containers and actuating means to reciprocally move a first and a second filling unit from an operating condition to a rest condition; wherein in an operating condition one between a first and second filling unit is arranged in the filling area and able to be in fluid communication with the containers to be filled; and wherein in the rest condition the other between the first and second filling unit is arranged in the rest area accessible to the operator without interrupting the filling of the containers in the filling area.

7 Claims, 4 Drawing Sheets

(56) References Cited

U.S. PATENT DOCUMENTS

| | | | | |
|---|---|---|---|---|
| 7,278,531 | B2 * | 10/2007 | Hartness | B65G 17/385 198/470.1 |
| 7,299,832 | B2 * | 11/2007 | Hartness | B65G 17/323 141/144 |
| 7,331,156 | B2 * | 2/2008 | Hartness | B65G 17/323 198/470.1 |
| 7,571,585 | B2 * | 8/2009 | Till | B29C 49/42 53/136.1 |
| 8,479,784 | B2 * | 7/2013 | Goldman | B67C 3/007 141/103 |
| 8,621,824 | B2 * | 1/2014 | Mielnik | A61L 2/208 422/28 |
| 2002/0139436 | A1 | 10/2002 | Rosen et al. | |
| 2007/0193652 | A1 * | 8/2007 | Till | B67C 7/0073 141/144 |
| 2010/0037986 | A1 * | 2/2010 | Neumann | B67C 3/22 141/91 |

* cited by examiner

FILLING APPARATUS FOR FILLING CONTAINERS AND RELATED METHOD

CROSS-REFERENCE TO RELATED APPLICATIONS

This application claims the benefit of Italian patent application No. BO2015A000092, filed Feb. 24, 2015.

TECHNICAL FIELD

The present invention relates to an apparatus for filling containers with fluid products provided with two reciprocally operating filling units. In particular, the present invention relates to an apparatus capable of ensuring access to a filling unit when the filling operation by the other filling unit is performed.

In a further aspect the present invention relates to a method for filling containers, comprising the reciprocal driving step of two filling units.

PRIOR ART

The containers of fluid bodies usually comprise a hollow body which defines in its inside a space for containing the product and provided with at least one filling opening. Examples of said containers can be flexible plastic containers, beverage capsules or bottles or containers provided with necks.

During production of the above type of containers, the hollow bodies are filled through the opening by a plurality of filling members typically arranged on a filling unit. Said opening is then sealed by heat sealing of an appropriately shaped wall and/or by the use of caps or additional known type closing means.

A known type filling apparatus is provided with suitable means for advancing the containers, able to drive a succession of incoming empty containers and a succession of outgoing filled containers. A portion of said apparatus, interposed between the entrance and the exit, is used to fill the containers with a suitable dose of a fluid product.

The products destined to fill said containers can be of many types, with different flavors, colors and chemical compositions. Therefore, the change of product for filling successive assemblies of containers with different products implies the need to clean the filling assemblies to avoid contamination between one change and the next. Said cleaning operations are typically carried out according to the known method being referred to as "Clean-In-Place" (CIP). This is a method for cleaning the internal surfaces of the pipes, tanks and all the devices in general that are involved in the filling operations (for example filters and fittings). The advantage of the use of CIP is the possibility to quickly perform the cleaning, automatically (without the use of specialized operators) and/or with reduced exposure of the operators to chemical agents.

To increase the efficiency of the apparatus and to overcome relatively long cleaning operations by means of CIP technology, it is known to use two filling units which are able to operate alternately on the succession of incoming containers, so that the cleaning operations of the two units do not create "bottlenecks" in the filling area.

A known apparatus of the above type is described, for example, in U.S. Pat. No. 5,690,151A. In particular, in said document, the apparatus is provided with a filling system comprising two filling units wherein while one unit is used for filling containers, the remaining unit and its respective circuit is cleaned by a CIP operation.

To provide proper apparatus maintenance and ensure high levels of hygiene, especially in the food and pharmaceutical field, it is necessary to conduct thorough cleaning operations, scheduled or exceptional, both of the dispensing nozzles and of the entire product feeding system. For operations of the above type the CIP systems are no longer usable as it is often necessary to provide for the disassembly of the components and not just the passage of cleaning liquid inside the loop circuit. On the contrary, a different known type of cleaning method called "Clean-Out-of-Place" (COP) is to be used.

The COP provides, therefore, that the components of the filling system are removed from their operative area and brought to a cleaning station, external to the filling apparatus and used for the restoration of the components themselves.

The filling units are arranged along the filling path and, for safety reasons, at appropriate safety barriers which prevent access to the operator during the filling operations. Consequentially, during the COP operations the apparatus must be stopped to allow the operator or robotic arms involved with the disassembly/assembly of the components to enter.

Therefore, during the COP operations the apparatus remains non-operating during a more or less long length of rest time, depending on the complexity of the liquid feeding circuit and maintenance time required and/or cleaning operations. The stop implies, therefore, a remarkable reduction of average efficiency of the same in terms of the amount of containers filled per time unit.

The patent application US2002139436A1 describes, in the embodiments of FIGS. 23-29, an apparatus for filling containers with fluid products that allows a CIP operation. In particular, the filling apparatus comprises a first assembly of filling members that is located in a filling area to perform the filling of the corresponding empty containers and a second assembly of filling members that is located in a rest area to perform a cleaning cycle; the two assemblies of operating members are mounted movable to cyclically move between the filling area and the rest area so that while an assembly of filling members is working, the other assembly of filling members is being cleaned.

DESCRIPTION OF THE INVENTION

The object of the present invention is to provide an apparatus for filling containers with fluid products which allows achieving high productivity and quality, and maintaining, at the same time, the cleaning and maintenance levels suitable for production needs.

A further object of the present invention is to provide an apparatus for filling containers which has a reduced overall dimension with respect to conventional machines.

According to the present invention, an apparatus for filling containers with fluid products, as claimed in the attached claims is provided.

The purposes mentioned above are further achieved by a method for filling containers with fluid products, according to the accompanying claims.

In this way, it is possible to perform CIP or COP operations to the unit arranged in the rest area without machine stops in the remaining part of the apparatus, thus maintaining high productivity.

BRIEF DESCRIPTION OF THE DRAWINGS

Further characteristics and advantages of the present invention will become apparent from the description of preferred embodiments, illustrated by way of non limitative examples in the accompanying figures, wherein.

PREFERRED EMBODIMENTS OF THE INVENTION

Figure 1:
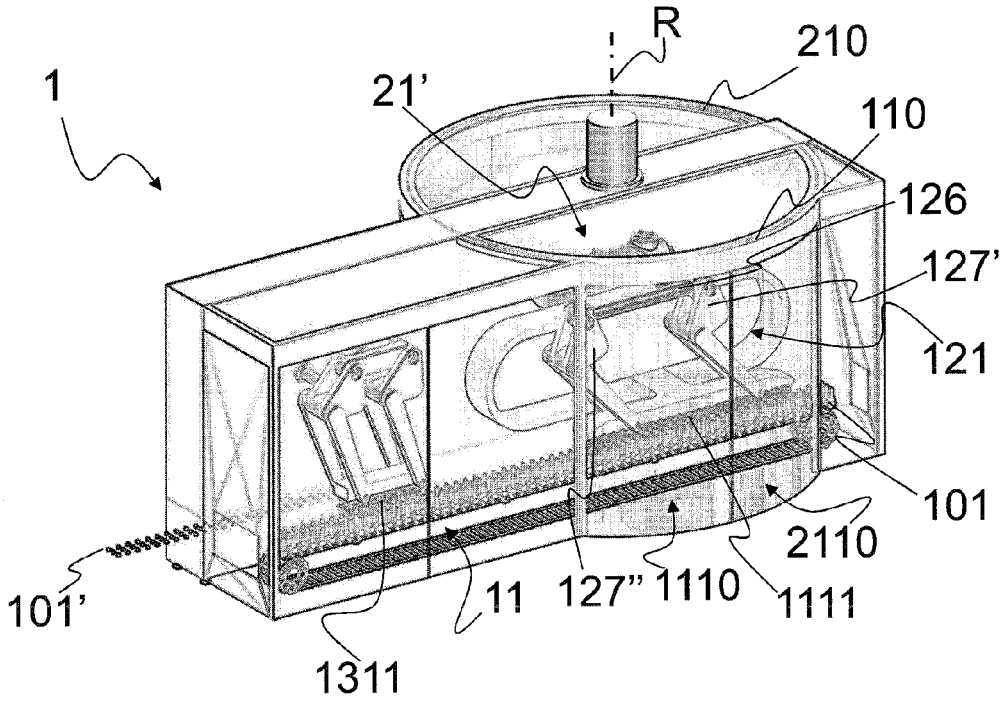
FIG. 1 is a front perspective view of a first embodiment of a filling apparatus for filling containers, according to the present invention.
Figure 2:
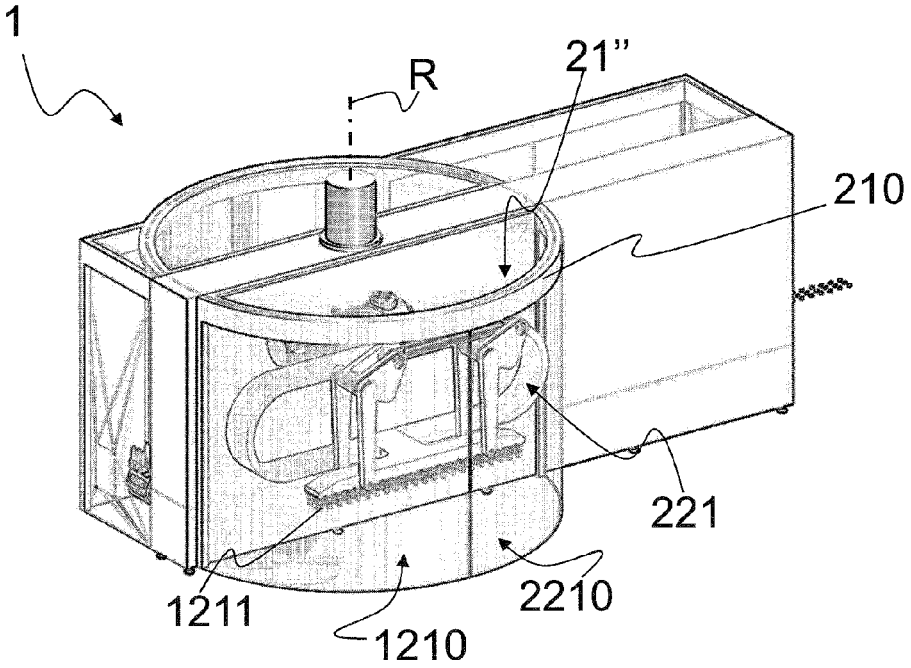
FIG. 2 is a rear perspective view of the first embodiment of the filling apparatus for filling containers, according to the present invention.
Figure 3:
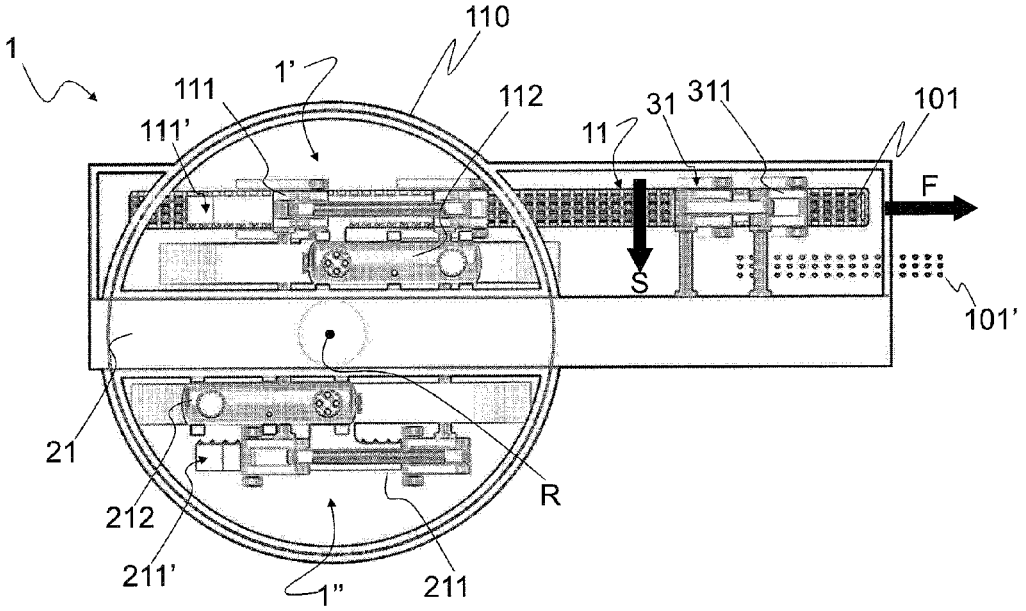
FIG. 3 is a top plan view of the first embodiment of the filling apparatus for filling containers, according to the present invention.

In FIGS. 1-3 number 1 denotes in its entirety an filling apparatus for filling containers 101 with fluid products according to the present invention, in a first embodiment.

In the following, reference will be made to the filling of a plastic bottle 101, as container example, provided with a heat-sealed wall 101' as closing means. The bottle 101 comprises a hollow body which is able to accommodate a dose of product in liquid or semi-liquid form. In the present example, the bottle 101 contains a concentrate liquid for obtaining a beverage. In use, the removal of the heat-sealed wall 101' allows access to the content to be fed together with water, or steam, for obtaining the desired beverage.

The filling apparatus 1 is provided with suitable means for advancing the containers 101 to be filled along a filling path. In particular, in the embodiment illustrated for the filling apparatus 1 the filling path is defined by the above said advancing means, thereby defining a linear type filling direction F for the aforesaid filling path. Said advancing means comprise a conveyor 11 defined by a conveyor belt closed in a loop on suitable driving means, in particular a drive pulley and a driven pulley in the embodiment described therein. The above said conveyor 11 comprises, therefore, an upper branch, supporting the plurality of containers 101 advancing in succession, and a corresponding lower branch, formed by the return portion during the forward movement. In particular, the conveyor 11 is provided with a plurality of seat rows for housing the containers 101. Each of said row is arranged in succession along the filling direction F and is able to house side by side in said rows two or more containers 101 along a housing direction S perpendicular to the filling direction F.

In a further embodiment (not illustrated), the conveyor is a plate-type conveyor, wherein each plate is provided with a plurality of seats arranged aligned along said housing direction S. This plurality of seats of each plate defines, therefore, each row of seats of the conveyor, as described above.

The advancing means, by way of the aforementioned conveyor 11, drive the incoming empty containers 101 to the apparatus 1 and the same outgoing containers 101 filled with a dose of said fluid product. The actuating means, in use, operate the conveyor belt of the conveyor 11 with a continuous motion and in step with the units forming the filling apparatus 1. In particular, the conveyor 11 feeds the empty containers to the filling unit 101 and subsequently to a closing unit to arrange them, finally, in a discharge area after closure is completed.

Upstream from the conveyor 11 a feeding device (not illustrated) 101 of the empty containers is provided. Moreover, downstream from the same conveyor 11 a removing device (not illustrated) for the containers 101 filled with the fluid substance is provided.

Along the path defined by the conveyor 11, in the filling direction F, a plurality of units able to operate sequentially on the containers 101 entered in the filling apparatus 1 are arranged in succession. The operating units are protected and enclosed by a metal structure 110 or casing. The latter is provided with a plurality of see-through windows made with suitable transparent panels, of plastic and/or glass material, to allow monitoring the filling process and avoiding, at the same time, that the operator, or assisting means can come into contact with the same operating units.

A filling area 1' is arranged along the filling path 101 into which the empty containers are filled with the dose of fluid product. The filling area 1' is provided with appropriate safety barriers for the operator, suited to prevent access to the area 1' itself when filling operations are performed.

In the embodiment described therein, the filling area 1' is defined by a portion of the metallic structure 110, as illustrated in FIGS. 1 and 3. The safety barriers are made from two movable panels 1110, 2110 of the metallic structure 110 provided with a safety switch (not illustrated). The movable panels 1110, 2110 are hinged to the metallic structure 110 so as to rotate with respect to the same to be set apart and allow access to the working units. The safety switch is connected to the main switch of the filling apparatus 1 and is normally turned off when the two movable panels 1110, 2110 are closed and prevent access to the operating units. The opening of the movable panels 1110, 2110, by allowing access to operating units, arranges the safety switch in the on position thus opening the electric circuit and acting on the main switch to interrupt the supply of electricity to the filling apparatus 1.

A portion of the filling apparatus 1 defines, on the contrary, a rest area 1", as illustrated in FIGS. 2 and 3. The rest area 1" is arranged outside of the filling path and of the filling area 1' and is accessible to the operator without interrupting the filling of the containers 101 in the filling area 1'. In particular, in the embodiment described therein the rest area 1" is opposing filling area 1'.

Also the rest area 1" is provided with a plurality of panels 1210, 2210 as portions of a further metal structure 210 or casing. The above-mentioned panels 1210, 2210 are movable with respect to the casing 210 but are devoid of the previously described safety switch. The panels 1210, 2210 are hinged to the movable metal structure 210 so as to rotate with respect to the same to be set apart and allow access to the working units. Being devoid of the safety switch, the opening of movable panels 1210, 2210 allows access to the working units without interrupting the feeding to the filling apparatus 1 and, therefore, ensuring operation continuity of the same.

In further embodiments (not illustrated) the rest area can be devoid of protective structures as previously described. Similarly, the rest area could be arranged in non-opposing positions with respect to the filling area 1' but simply set apart from the same, for example by means of safety barriers provided for the filling area 1' itself.

In further embodiments (not illustrated), the movable panels arranged in the rest area can be provided with a safety switch operatively connectable only to the working units arranged in said area and not to the main switch of the apparatus. Also in said case, the opening of the panels allows access to the working units without interrupting the supply of electricity to the filling and, therefore, ensures the operation continuity of the same.

In the embodiment illustrated in FIGS. 1-3, the operating units of the filling apparatus 1 comprise a first filling unit 111 and a second filling unit 211 for filling the moving incoming containers 101. The filling apparatus 1 is also provided with a further application unit 311 for the application of the closures 101' to the filled containers 101 arranged downstream from the above mentioned filling units 111, 211.

Each of the first 111 and second 211 filling unit comprises an assembly of filling members 1111, 1211, or dispending nozzles, able to feed the dose of fluid product inside the corresponding containers 101. These are driven by way of a support structure 111', 211' and arranged in a plurality of rows of filling members, or dispensing nozzles. In particular, said assembly of filling members 1111, 1211 is preferably arranged in equally spaced rows. Furthermore, the number of filling members 1111, 1211 in each row is equal to the number of the containers 101 carried advancing by the conveyor 11 and arranged along the housing direction S.

The first 111 and second 211 filling unit are, therefore, able to feed the doses of fluid product along the filling path at the filling area 1', in particular along the filling direction F. In contrast, in the rest area 1" the same units 111, 211 are non-operating. In particular, said filling units 111, 211 operate in reciprocity, i.e. with mutual reverse logic: when one of the two filling units 111, 211 is arranged in the filling area 1' the remaining unit is arranged in the rest area 1" and vice versa.

Additionally, the first 111 and second 211 filling unit can be provided with or operatively connected to a weighing system arranged correspondingly opposing each nozzle. Said weighing system is capable of weighing the amount of measured liquid by comparing the same with the reading of a flowmeter able to control the dosing operated by means of the filling members 1111, 1211, possibly operating retroactively and by varying the feeding parameters. In this way it is also possible to detect malfunctions and wear before the filling efficiency reaches values below predetermined minimum threshold values.

The filling unit arranged in the filling area 1' is in the operating condition and in fluid communication with the containers 101 to be filled, thus allowing the filling of the containers 101 with the fluid substance. The remaining unit is arranged in the rest area 1" in resting conditions, with respect to the filling operations of the containers 101 with the fluid substance.

The two filling units 111, 211 are, therefore, reciprocally movable from an operating condition to a rest condition.

In the present invention, the term reciprocally signifies that the movement of the two filling units takes place mutually or interchangeably so that when one of the filling units is arranged in the operating condition the other is arranged in the rest condition and vice versa.

The movement from the operating condition to the rest condition is performed by means of suitable actuating means of the filling apparatus 1. In the embodiment illustrated in FIGS. 1-3 said actuating means comprise a support structure rotatable about a vertical axis of rotation R. The first 111 and second 211 filling unit are arranged on the support structure 21 so that the movement of the same, i.e. the rotation with respect to the vertical axis R, enables the reciprocal arrangement of the units in the operating condition and in the rest condition.

The support structure 21 defines a partition wall between the filling area 1' and the rest area 1". In particular, said first 111 and second 211 filling unit are arranged on opposing surfaces 21', 21" of the partition wall 21. In this way, the rotation of the partition wall corresponds to the reciprocal driving of the filling units 111, 211 in the corresponding filling 1' and rest 1" areas.

Each of the filling units 111, 211 is provided with a respective driving device able to drive the filling unit during the advancement of the containers 101 and/or to approach the filling members 1111, 1211 at the openings of the containers 101 themselves. This can be an integral part of the units 111, 211 themselves or part of the filling apparatus 1, separated but operatively connected to the respective filling unit.

The driving devices are able to drive the first 111 and second 211 filling unit parallel to the filling direction F with a law of motion which provides an operating step and a return step. In the operating step, the filling members 1111, 1211 move from a start filling position to an end filling position of the containers 101 advancing in the same direction and in synchronism with the conveyor 111. During the above said operating step each filling member 1111, 1211 remains operatively connected at all times to the corresponding container 101. The above mentioned law of motion also provides a return step, wherein the filling members 1111, 1211 move from the end filling position, to the start filling position advancing in the opposite direction with respect to said conveyor 111.

In the embodiment illustrated in FIGS. 1 and 3, the first driving device for the first filling unit 111, arranged in the filling area 1', comprises an articulated crank mechanism 121 which determines the movement of the support structure 111' with respect to the filling apparatus 1. Said articulated crank mechanism 121 comprises two support structures hinged in two opposing portions of the support structure 21, and in particular at the ends arranged along the filling direction F. Said support structures comprising each two arms able to balance the distribution of the forces resulting from moving the filling unit 111. The two support structures are connected by way of a rod 126 arranged parallel to the conveyor 111 and able to be driven linearly along said filling direction F with an alternating motion. In particular, the two support structures and the rod 126 are connected to each other by way of the interposition of respective crank elements 127', 127" able to convert the linear movement of the rod 126 into a rotation of the cranks 127', 127". In this way, the movement of the rod 126 along the opposite direction with respect to the advancement of the conveyor 11 places the first filling unit 111 during the operating step following the movement of the conveyor 11. Similarly, the shifting of the rod 126 along the advancement direction of the conveyor 11 arranges the first filling unit 111 in return step.

In FIG. 2 the second driving device for the second filling unit 211 is illustrated, arranged in the rest area 1". Said driving device comprises an articulated crank mechanism 221 that determines the movement of the support structure 211' with respect to the filling apparatus 1, when the second filling unit 211, to which is operatively connected, is arranged in the filling area 1'. Said articulated crank mechanism 221 is equivalent to the articulated crank mechanism 121 previously described for the first driving device, to which reference is made.

The feeding of the fluid product to the filling units 111, 211, and consequently to the containers 101, is obtained by means of suitable feeding means arranged in fluid communication with said filling units 111, 211. In particular, the apparatus 1 comprises a first tank 112 and a second tank 212 able to contain the fluid product to be filled. In the embodiment illustrated therein, said tanks 112, 212 are respectively arranged at the first 111 and second 211 filling unit. Similarly, the arrangement of the above mentioned tanks can be different and they can be arranged at only one of said filling units, for example, or, alternatively, arranged at a portion of the filling apparatus set apart from the filling unit and/or from the filling and/or rest areas.

The tanks 112, 212 are preferably able to accommodate two different filling liquids. In this way, it is possible to quickly make a product exchange without waiting for the emptying and cleaning of the single tank. Similarly, the two tanks can accommodate the same liquid product to be filled and one being simply the back-up for the other so as to ensure coverage continuity during cleaning or maintenance of one of the two units or of one of the two tanks.

The apparatus 1 comprises, therefore, first feeding means of the fluid product (not illustrated) from the first tank 112 to the first filling unit 111. Similarly, the filling apparatus 1 is provided with second feeding means of the fluid product (not illustrated) from the second tank 212 to the second filling unit 211.

Both feeding means are operatively connected to the actuating means of the first 111 and second 211 filling unit. In this way, it is possible to place in fluid communication the first 112 or the second 212 tank with the first 111 or the second filling unit 211 respectively, when these are arranged in the operating condition, i.e. in the filling area 1'. Said operating connection can be made, for example, by means of one-way valve, arranged between a tank and the respective filling unit and driven by the actuating means by placing the valve in the open position when the actuating means arrange the filling unit in the filling area 1'.

In an alternative embodiment (not illustrated), the filling apparatus can be provided with a single tank for the fluid product which mutually feeds one of the two filling units. In said embodiment, the apparatus is provided with feeding means of the fluid product that branch off from the tank up to the filling unit, for example a connection by means of an three-way check valve. Also in said embodiment, the feeding means are operatively connected to the actuating means to place the tank in fluid communication with the filling unit arranged in the operating condition, i.e. in the filling area 1', since not being in fluid communication with the mutual filling unit arranged in the rest condition in the rest area 1".

Additionally, to ensure the cleaning operations by means of the Clean-In-Place system (CIP), the filling apparatus further comprises a stock of a cleaning product, preferably arranged in a further tank (not illustrated), separate from the previous ones. The feeding of the cleaning product is made by way of cleaning means, for example as a cleaning circuit, and operatively connected to the stock of cleaning product.

In the embodiment illustrated in FIGS. 1-3, said stock of cleaning product and said cleaning means are integrated in the actuating means and, in particular, in the partition wall 21 formed by the same. According to further embodiments these could be also arranged on the outside, as illustrated for the first 112 and second 212 tank.

The cleaning means are operatively connected to the actuating means to place in fluid communication the stock of cleaning product respectively with the first 111 or the second filling unit 211 when arranged in the rest condition, i.e. in the rest area 1". Also in said case, it is possible to use, for example, an three-way check valve, arranged between the stock of cleaning product and the respective filling units; said valve can be driven by the actuating means by placing the valve in the open position on one of the two exit way of the corresponding filling unit arranged by the actuating means in the rest area 1".

Downstream from the filling units 111, 211 and along the first conveyor 11 an application unit 311 for the application of the closures 101' to the filled containers 101 is arranged. Said application unit 311 is provided with an assembly of welding heads 1311 able to simultaneously apply the closures to all the containers 101 arranged in each of the rows, and continuously to the rows advancing in succession. The application unit 311 comprises a support structure 31 provided with the assembly of welding heads 1311 arranged in equally spaced rows. Preferably, the number of welding heads 1311 in each of the rows is equal to the number of retaining seats in each of the rows of the conveyor 111.

The welding heads 1311 are arranged in fixed positions in the support structure 31 and in particular individually equally spaced in the rows, along the housing direction S, and further equally spaced between the rows, along the filling direction F. The above mentioned equally spaced positions correspond to the spacing between the retaining seats in each of the rows of the conveyor 111 and the spacing between the seats arranged in succession, respectively. Consequently a non-uniform spacing of the seats or different dimensions of the retaining seats can need a different or non-equally spaced arrangement of the welding heads 1311.

At the application units 311, the filling apparatus 1 comprises a third driving device able to drive said application unit 311. This can be an integral part of the unit 311 itself or part of the filling apparatus 1, separated but operatively connected to said application unit 311.

Said third driving device is able to drive the application unit 311 parallel to the filling direction F with a law of motion which provides an operating step and a return step. In the operating step, 1311 the welding heads are moved from a start welding position to an end welding position of the containers 101 advancing in the same direction and in synchronism with the conveyor 111. During the above mentioned operating step 1311 each welding head remains operatively connected at all times to a corresponding container 101. The above mentioned law of motion foresees, furthermore, a return step, wherein the welding heads 1311 move from the end welding position to the start welding position by advancing in the direction opposite to the above mentioned conveyor 111.

The driving device of the application unit 311 is made by means of a crank mechanism 131 equivalent to that previously described for the crank mechanisms 121, 221 of the first 111 and second 211 filling unit, respectively, to which reference is made.

In use, the containers 101 are advanced along the filling F path defined by the conveyor 111 which transports them. In particular, the empty containers 101 are arranged on the conveyor 111 upstream from the operating units.

One between the first 111 and second 211 filling unit is arranged in operating condition in the filling area 1' and in fluid communication with the containers 101 to be filled. In the operating condition the units 111, 211 are, therefore, driven parallel to the conveyor 111 by the respective driving device.

In particular, in the embodiment illustrated in FIGS. 1-3, the first filling unit 111 is arranged in the filling area 1' and the second filling unit 211 is arranged in the rest area 1", reciprocally.

In the filling area 1' arranged along the filling path the incoming empty containers 101 are therefore filled with a dose of fluid product from the first 111 filling unit provided with the plurality of filling members 1111. Said filling area 1' is provided with safety barriers for the operator able to prevent access to the area 1' itself during the filling step.

Reciprocally, the remaining second filling unit 211 is arranged in rest condition in the rest area 1" out of the filling path and, consequently, of the filling area 1'. In the rest condition, to the filling unit 211 arranged therein cleaning of the corresponding portion of the filling apparatus 1 can be carried out. This is formed by the same unit and by means able to perform the fluid communication with the second tank 212, for example by way of the Clean-In-Place (CIP) system.

In the present invention, the term Clean-In-Place signifies the set of operations designed to sanitize the devices without the disassembly of the same. In particular, the CIP involves cleaning the internal surface of pipes, tanks, filters, fittings and further elements of the filling circuit.

To perform the CIP operations the stock of cleaning liquid is, therefore, placed in fluid communication with the second filling unit 211. For example, the three-way check valve is arranged, during the movement of the actuating means of the support structure 21, in open position allowing the passage of the cleaning liquid from the stock to the only second filling unit 211 and to the filling circuit connected thereto. In this way, the first filling unit 111 is isolated from the cleaning circuit, while maintaining the operative and fluid connection to the first tank 112 and the respective feeding circuit of the liquid contained therein.

The CIP operations on the second filling unit 211 arranged in the rest area 1" can be made, for example, by providing highly turbulent solutions and at high flow rate of the cleaning liquid and spray solutions. Preferably, moreover, said cleaning product is heated at high temperatures to improve the cleaning effect.

During the cleaning operations by means of CIP, a tray which collects the cleaning liquid and allows to repeatedly recycle the same can be further arranged under the nozzles.

The rest area 1" is accessible to the operator without interrupting the filling of the containers 101, i.e. without interrupting the feeding of the filling apparatus 1 to the first filling unit 111 arranged in the filling area 1'. In particular, it is possible to perform cleaning operations by means of the Clean-Out of the-Place (COP) system or maintenance and replacement of operating units arranged in the rest area 1", and in particular of the second filling unit 211 arranged therein.

In the present invention, the term Clean-Out of the-Place signifies the set of cleaning operations suited to sanitize the devices by way of disassembly the same. In particular, the COP provides the cleaning of the internal and external surface of pipes, tanks, filters, fittings and further elements of the filling circuit. The dispensing nozzles can be devoid of electrical and/or pneumatic cabling, being easily replaceable during the COP or maintenance operations.

The COP operations on the second filling unit 211 arranged in the rest area 1" can be made, for example, proceeding with the opening of the panels 1210, 2210 part of the metal structure 210 of the rest area 1". These allow access to the second filling unit 211 without interrupting the operation of the first filling unit 111 and, therefore, maintaining high productivity of the apparatus 1.

Furthermore, cleaning and/or drying of the apparatus can be assisted by an assisting robot which allows automatic operability on the outside of the apparatus and of its components arranged in the rest area. In particular, said assisting robot can operate safely even in the presence of the operator without need of any shelter or separation, increasing the efficiency and speed in the cleaning and/or maintenance operations of the rest area.

When the cleaning of the first filling unit 111 is necessary, or as a result of a need of product change, the actuating means perform the reciprocal movement of the two filling units 111, 211 by taking the first unit 111 from the operating condition to the rest condition, i.e. from the filling area 1' to the rest area 1", allowing possible performing of the CIP and/or COP operations. Mutually, the same actuating means take the second filling unit 211 from the rest condition to the operating condition, i.e. from rest area 1" to the filling area 1', allowing the dispensing of the fluid product contained within the second tank 212, associated thereto, to the corresponding advancing containers.

Figure 4:
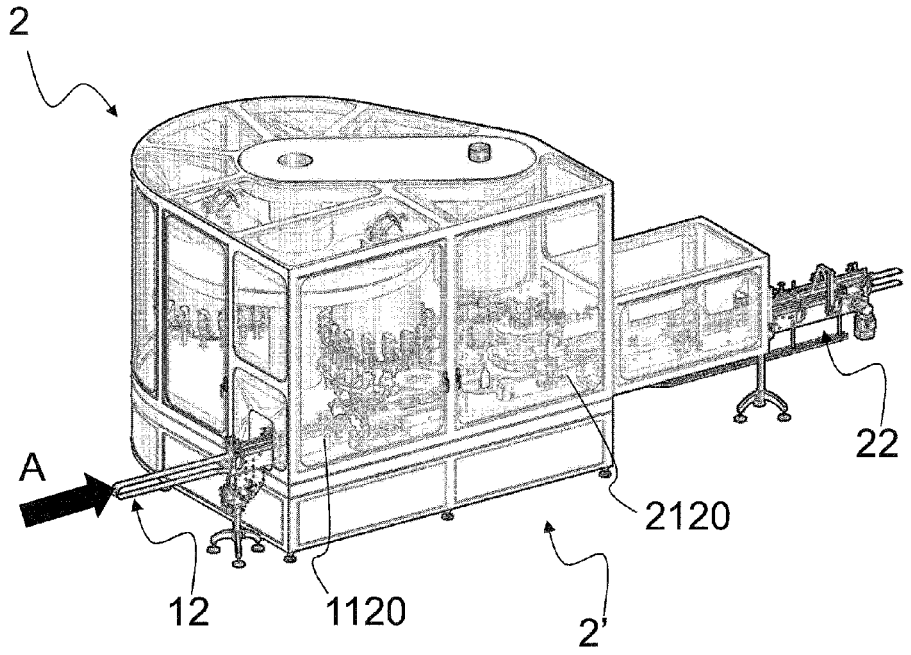
FIG. 4 is a front perspective view of a second embodiment of a filling apparatus for filling containers, according to the present invention.
Figure 5:
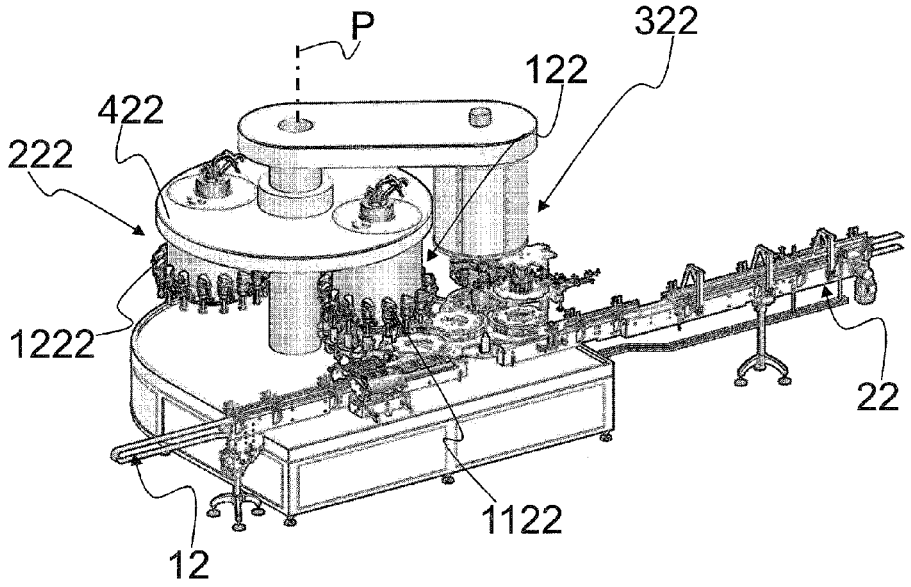
FIG. 5 is the front perspective view of FIG. 4, wherein the filling apparatus for filling containers is devoid of the operating unit protective casing.
Figure 6:
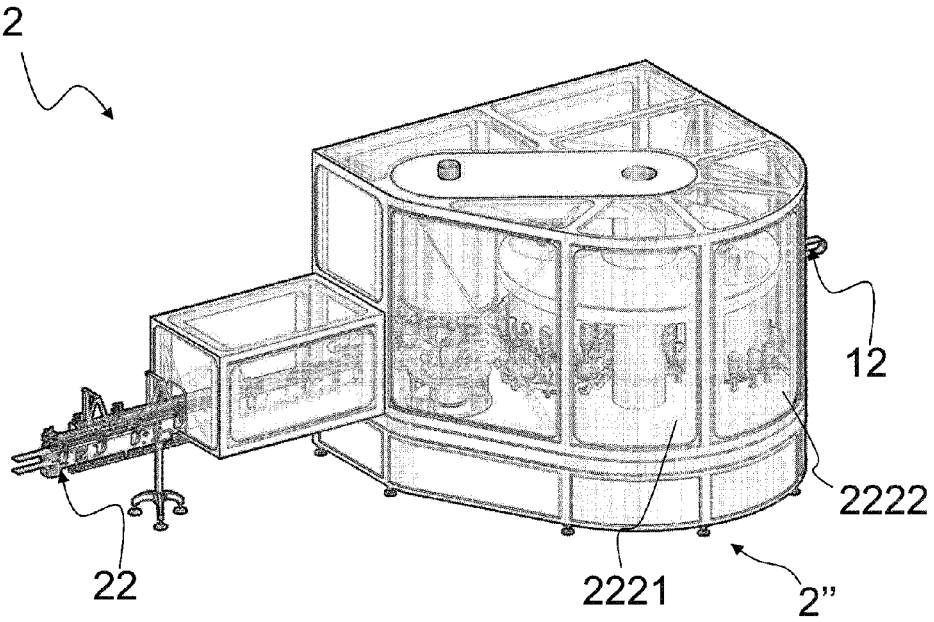
FIG. 6 is a rear perspective view of the second embodiment of the filling apparatus for filling containers, according to the present invention.
Figure 7:
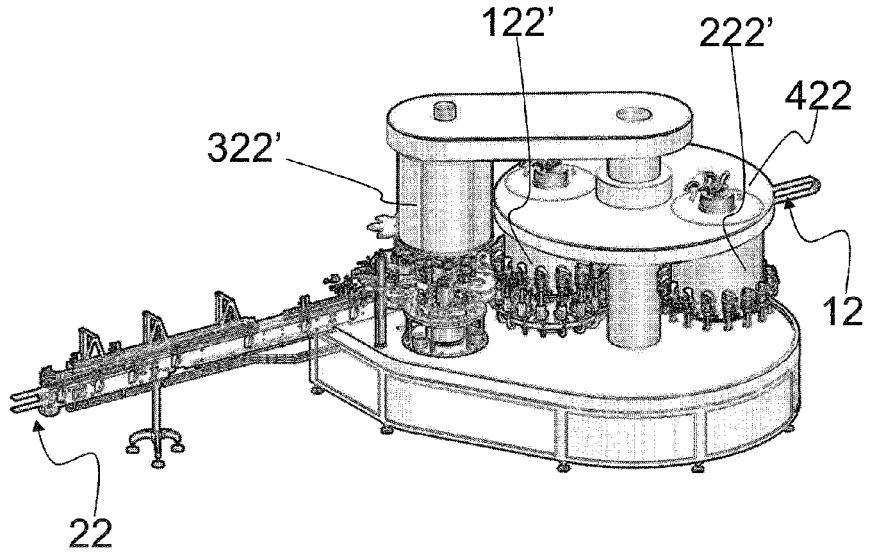
FIG. 7 is a rear perspective view of FIG. 6, wherein the filling apparatus for filling containers is devoid of the operating unit protective casing.

In FIGS. 4 and 6 number 2 denotes as a whole an apparatus for filling containers with fluid products according to the present invention, in a second embodiment. In FIGS. 5 and 7 is illustrated the same apparatus 2 devoid of the casing protecting the operating units, as subsequently described in detail.

In the following, reference will be made to the filling of a plastic bottle (not illustrated) provided with a screw cap (not illustrated) applied to the collar at an opening. The bottle comprises a hollow body which is suited to house a dose of product in liquid or semi-liquid form. In this example, the bottle contains a concentrated liquid for producing a beverage.

In use, the removal of the screw cap allows access to the contents to be mixed, with water or steam, to obtain the desired beverage.

In particular, in the embodiment illustrated in FIGS. 4-7 the apparatus 2 comprises a first filling unit 122 and a second filling unit 222 for filling the empty containers and an application unit 322 for the application of the screw caps.

The filling apparatus 2 is provided with suitable advancing means of the bottles along a filling path. Said feeding means comprise a first conveyor 12 and a second conveyor 22. Both conveyors 12, 22 are each defined by a conveyor belt forming a loop on appropriate driving means. Said conveyors 12, 22 support, therefore, the plurality of the bottles advancing in succession on an upper branch of said belts.

The first conveyor 12 allows the driving of the incoming empty bottles to the apparatus 2 while the second conveyor 22 allows the driving of the same outgoing bottles filled with a dose of fluid product. In particular, in the embodiment illustrated therein, the first conveyor 12 feeds the empty bottles to the filling unit while the second conveyor 22 receives the bottles that have been filled and closed by the application unit 322 that applies the screw caps.

To allow to continually transfer the bottles between the filling unit and the application unit and between the conveyors 12, 22, the advancing means further comprise a plurality of transfer wheels placed between the first 12 and second 22 conveyor and between the filling unit and the application unit. These allow the continuous extraction of the bottles from the first conveyor 12 to the filling unit which is arranged in the filling area 1', and then to driving of the bottles filled by the filling unit to the application unit and, finally, from the application units to the second conveyor 12.

Therefore, in the embodiment illustrated for the filling apparatus 2 the filling path is defined in part by said advancing means, thereby defining a filling direction A of mixed type, i.e. comprising linear stretches, defined in particular by the conveyor, and circular stretches, defined in particular by the transfer wheels. In addition, the first 122 and the second 222 filling unit define part of said filling path when arranged in said operating condition.

The driving means, in use, drive the conveyor belts of the conveyors 12, 22 and the transfer wheels with continuous motion and in phase with the units forming the apparatus 2.

Upstream from the first conveyor 12 a feeding device (not illustrated) of the empty bottles is provided. Similarly, downstream from the second conveyor 22 a removal device (not illustrated) of the bottles filled with the fluid substance is provided. Along the path defined by the advancing means a plurality of units are arranged in succession, able to operate in sequence on the bottles introduced in the apparatus 2. The operating units are protected and defined by a metal structure 120 or casing. This is provided with a plurality of inspection windows made with suitable transparent panels, in plastic and/or glass material, to allow the monitoring of the filling process and avoiding at the same time that the operator, or assisting means can come into contact with the same operating units.

A portion of the metal structure 120 defines a filling area 2', as illustrated in FIG. 4. The filling area 2' is arranged along the advancing path within which the empty bottles are filled with the dose of fluid product and is provided with appropriate safety barriers for the operator, which can prevent access to the area 2' itself when filling operations are performed. As previously described for the filling apparatus 1, the safety barriers consist of two movable panels 1120, 2120 of the metal structure 120 provided with a safety switch (not illustrated). The movable panels 1120, 2120 are hinged to the metal structure 120 so as to rotate with respect to the same to be set apart and allow access to the working units. The safety switch is connected to the main switch of the apparatus and is normally turned off when the two movable panels 1120, 2120 are closed and prevent access to the operating units. The opening of the movable panels 1120, 2120, by allowing access to operating units, arranges the safety switch in the on position thus turning on the electric circuit and acting on the main switch to interrupt the power supply to the feeding apparatus 2.

A portion of the apparatus 2 opposing filling area 2' defines, in contrast, a rest area 2", as illustrated in FIG. 6. The rest area 2" is arranged outside the advancing path. In particular, also the rest area 2" is provided with a plurality of panels 2221, 2222, portions of the same metal structure or casing 120. The above panels 2221, 2222 are movable with respect to the casing 120 but are devoid of the previously described safety switch. The movable panels 2221, 2222 are hinged to the metal structure 120 so as to rotate with respect to the same to be set apart and allow access to the working units. Being devoid of the safety switch, the opening of the movable panels 2221, 2222 allows access to the working units without interrupting the power supply to the apparatus 2 and, thus, ensuring the operation continuity of the same.

In further embodiments (not illustrated) the rest area can be devoid of protective structures as previously described for the filling apparatus 1. Similarly, the rest area 2" can be arranged in non-opposing positions with respect to the filling area 2' but simply set apart from the same, for example by means of safety barriers provided for filling area 2' itself.

In further embodiments (not illustrated), the movable panels arranged in the rest area can be provided with a safety switch operatively connected only to the working units arranged in said area and not to the main switch of the apparatus. Also in said case, the opening of the panels allows access to the working units without interrupting the power supply to the apparatus and, therefore, ensures the operation continuity of the same.

In the embodiment illustrated in FIGS. 4-7, the operating units of the apparatus 2 comprise a first filling unit 122 and a second filling unit 222 for filling the incoming moving bottles. The apparatus 2 is also provided with a further application unit 322 for the application of the screw caps on the filled bottles arranged downstream from the aforementioned filling units 122, 222.

Each of the first 122 and second 222 filling unit comprises a support structure 122', 222' for an assembly of filling members 1122, 1222. Said support structures 122', 222' are each formed by a conveyor rotatable about a vertical axis of rotation, defining part of the filling path when said filling units 122, 222 are reciprocally arranged in operating condition in the filling area 2'. In particular, the rotation is achieved with continuous motion about the aforementioned vertical axis of rotation to advance cyclically along a portion of the circular filling path defined thereby. Each of said rotatable conveyors 122', 222' supports the plurality of filling members 1122, 1222, able to feed a dose of fluid within the corresponding container. In particular, the filling members 1122, 1222 are arranged in equally spaced positions along the periphery of the respective rotatable conveyors 122', 222' and are oriented with the dispensing mouth arranged vertically. To allow dispensing of the dose of product, the filling members 1122, 1222 are, furthermore, operatively connected to a feeding circuit of the liquid substance to be filled, comprising two separate tanks, as described in detail hereinafter.

The first 122 and second 222 filling unit are, therefore, suitable to feed doses of fluid product along the filling path at the filling area 2'. In particular, when arranged in the operating condition, i.e. in said filling area 2', the first 122 and second 222 filling unit define part of the aforesaid filling path.

On the contrary, in the rest area 2" the same units 122, 222 are not operative for filling when in rest condition. In particular, said filling units 122, 222 operate in reciprocity, i.e. with mutual reverse logic, as previously described for the two filling units 111, 211 of the apparatus 1, to which reference is made. Therefore, the filling unit arranged in the filling area 2' is, in operating condition, performing the filling of the bottles with the fluid substance while the remaining unit is arranged in the rest area 2" in a rest and non-operating condition with respect to the filling operations of the bottles with the fluid product.

The two filling units 122, 222 are, therefore, reciprocally movable from the operating condition to the rest condition.

The movement from the operating condition to the rest condition is performed by means of suitable actuating means of the apparatus 2. In the embodiment illustrated in FIGS. 4-7 said actuating means comprise a support structure 422 rotatable about a vertical axis of rotation P. In particular, this defines a carousel on which the aforesaid first 122 and second 222 filling units are mounted in opposing position.

These are arranged on the support structure 422 so that the movement of the same, i.e. the rotation with respect to the vertical axis P, allows the reciprocal arrangement of the units in the operating condition and in the rest condition. In this way, the rotation of the support structure 422 corresponds to the reciprocal driving of the filling units 122, 222 in the corresponding filling 2' and rest 2" areas.

The feeding of the fluid product to the filling units 122, 222, and, consequently, to the empty bottles, is obtained by means of suitable feeding means placed in fluid communication with said filling units 122, 222. In particular, the apparatus 2 comprises a first tank and a second tank (not illustrated) able to contain the fluid product to be filled. In the embodiment illustrated therein, said tanks are respectively arranged within each of the rotatable conveyors 122', 222'. Similarly, the arrangement of the aforesaid tanks can be different and, for example, they can be arranged at only one of said filling units or, alternatively, arranged at a portion of the apparatus set apart from the filling unit and/or from the filling and/or rest areas.

The tanks are preferably able to accommodate two different filling liquids. In this way, it is possible to quickly make a product change without waiting for the emptying and cleaning of the single tank. Similarly, the two tanks can house the same liquid product to be filled one being simply the back-up for the other so as to ensure filling continuity during cleaning or maintenance of one of the two units or of one of the two tanks.

The apparatus 2 comprises, therefore, first feeding means of the fluid product (not illustrated) from the first tank to the first filling unit 122. Similarly, the apparatus 2 is provided with second feeding means of the fluid product (not illustrated) from the second tank to the second filling unit 222.

Both the feeding means are operatively connected to the actuating means of the first 122 and second 222 filling unit in the filling 2' and rest 2" areas. In this way, it is possible to place in fluid communication the first or the second tank with the first 122 or the second filling unit 222, respectively, when these are arranged in the operating condition, i.e. in the filling area 2'. Said operating connection can be, for example, made by means of a one-way valve, arranged between a tank and the respective filling unit and driven by the actuating means by placing the valve in the open position when the actuating means arrange the filling unit in the filling area 2'.

In an alternative embodiment (not illustrated), the apparatus can be provided with a single tank for the fluid product which feeds mutually one of the two filling units. In said embodiment, the apparatus is provided with feeding means of the fluid product that branch off from the tank up to the filling unit, for example a connection by means of an three-way check valve. Also in said embodiment, the feeding means are operatively connected to the actuating means to place the tank in fluid communication with the filling unit arranged in the operating condition, i.e. in the filling area 2', not being in fluid communication with the reciprocal filling unit arranged in a rest condition in the rest area 2".

Additionally, to ensure the cleaning operations by means of the Clean-In-Place (CIP) system, the apparatus further comprises a stock of a cleaning product, preferably arranged in a further tank (not illustrated), different from the previous ones.

The feeding of the cleaning product is made by means of cleaning means (not illustrated), operatively connected to said stock of cleaning product.

The cleaning means are operatively connected to the actuating means to place in fluid communication the stock of cleaning product with the first 122 or the second filling unit 222, respectively, when they are in the rest condition, i.e. in the rest area 2". Also in this case, it is possible to use, for example, a three-way check valve, arranged between the stock of the cleaning product and the respective filling unit; said valve is driven by the actuating means for being arranged in the open position on one of the two exit ways corresponding to the filling unit arranged in rest condition in the rest area 2" by the actuating means.

Downstream from the filling units 122, 222 and at the second conveyor 22 an application unit 322 for the application of the screw caps to the filled bottles is arranged. Said application unit 322 is provided with an assembly of screwing heads 1322 able to sequentially apply the closures to all the bottles arranged along the periphery of the same application unit 322 and advancing in succession in continuous motion.

The application unit 322 also comprises a support structure 322' defined, as for the filling units 122, 222, by a conveyor rotating about a vertical axis of rotation. In particular, the rotation is performed with continuous motion about the aforementioned vertical axis of rotation cyclically defining a further portion of the filling path A. The assembly of screwing heads 1322 is supported by the conveyor 322' rotatable in equally spaced positions along the periphery of the same and with the screw head arranged vertically. Preferably, the number of screwing heads 1322 is equal to the number of dispensing mouths arranged on the filling units 122, 222.

In use, the empty bottles are advanced along the filling path A defined by the conveyors 12, 22 which carry them and partially by the filling unit arranged in operating conditions in the filling area 2' and by the application unit 322 for the application of the screw caps.

One between the first 122 and second 222 filling unit is arranged in operating condition in the filling area 2' and able to be placed in fluid communication with the bottles to be filled. In the operating condition the units 122, 222 are, therefore, driven in rotation downstream from the first conveyor 12 by the respective driving device, respectively.

In particular, in the embodiment illustrated in FIGS. 4-7, the first filling unit 122 is arranged in the filling area 2' and, reciprocally, the second filling unit 222 is arranged in the rest area 2".

In the filling area 2' arranged along the filling path the incoming empty bottles are, then, filled with a dose of fluid product 122 by means of the first filling unit provided with the plurality of filling members 1122. Said filling area 2' is provided with safety barriers for the operator able to prevent access to the area 2' itself during the filling step.

Reciprocally, the remaining second filling unit 222 is arranged in rest condition in the rest area 2" out of the filling path A and, consequently, of the filling area 2'. In the rest condition, the filling unit 222 arranged therein can perform the cleaning of the portion of the apparatus 2 formed by the same unit and by the means able to provide fluid communication with the second tank, for example by means of Clean-In-Place (CIP) system.

To perform the CIP operations the stock of cleaning liquid is, therefore, placed in fluid communication with the second filling unit 222. For example, the three-way check valve is arranged, during the movement of the actuating means of the support structure 122', in the open position allowing the passage of the cleaning liquid from the stock only to the second filling unit 222 and to the filling circuit connected thereto. In this way, the first filling unit 122 is isolated from the cleaning circuit, while maintaining the operating and fluid connection to the first tank and the respective feeding circuit of the liquid contained therein.

As previously described for the apparatus 1, the CIP operations on the second filling unit 222 arranged in rest area 2" can be made, for example, by providing highly turbulent solutions and at high flow rate of the cleaning liquid and spray solutions. Preferably, moreover, said cleaning product is heated at high temperatures to improve the cleaning effect.

Similarly, said rest area 2" is accessible to the operator without interrupting the filling of the bottles, i.e. without interrupting the feeding of the apparatus 2. In particular, it is possible to perform cleaning operations by means of Clean-Out of the-Place (COP) system or of maintenance and replacement of the operating units arranged in the rest area 2", and in particular of the second filling unit 222 arranged therein.

The COP operations on the second filling unit 222 arranged in rest area 2" can be made, for example, by proceeding with the opening of the panels 2221 2222 120 parts of the metal structure of the rest area 2". These allow access to the second filling unit 222 without interrupting operation of the first filling unit 122 and, therefore, maintaining high productivity of the apparatus 2.

When cleaning of the first filling unit 122 is necessary, or as a result of needing a product change, the actuating means perform the reciprocal driving of the two filling units 122, 222 by arranging the first filling unit 122 from the operating condition to the rest condition, i.e. from the filling area 1' to the rest area 1", thus allowing the possible performing of the CIP and/or COP operations. Mutually, the same actuating means arrange the second filling unit 222 from the rest condition to the operating condition, i.e. from rest area 1" to the filling area 1', allowing the dispensing of the fluid product contained within the second tank associated thereto with the corresponding advancing containers.

The filling apparatus described above can be further provided with a further unit used for controlling the performed sealing/closing or the correct filling of the containers or bottles (not illustrated). In this case, the apparatus can further comprise a discharging station (not illustrated) arranged, for example, at the end of a conveyor.

Furthermore, the filling apparatuses described above can also be used for filling capsules, provided with one or more closing walls of one or more openings, without requiring significant modifications.

The filling apparatuses 1, 2 described above have many advantages.

In the first place, it is possible to obtain hourly production, i.e. high number of containers or bottles in the time unit, while ensuring an equally high quality standard in the filling of the same.

The apparatus according to the present invention allows, in fact, to obtain a significantly higher production, the same drive of the units being responsible for the filling of containers/bottles, since all the cleaning and maintenance operations of the filling unit are performed during the continuous movement of the advancing means and without interruptions.

Furthermore, the possibility of identifying a filling area and a rest area allows to arrange the filling unit reciprocally respectively in operating or non-operating position thus allowing the operator to perform cleaning and maintenance operations without moving away from the apparatus in movement.

Thanks to the synergistic combination of a plurality of features (the actuating means comprise a support structure for the filling units 111, 211; 122, 222 which is rotatable about a vertical axis of rotation, the support structure comprises a partition wall between the rest 1' and the filling 2' areas, and the two filling units 111, 211; 122, 222 are arranged on opposing surfaces of the partition wall) an adequate isolation (separation) between the filling area 1' and the rest area 2' is ensured without, at the same time, penalizing the movement of the filling units 111, 211; 122, 222 between the filling area 1' and the rest area 2'. In other words, the partition wall ensures a very good isolation (separation) between the rest 1' and filling 2' areas and, at the same time, does not ever need to be disassembled/removed during the movement of the filling units 111, 211; 122, 222 (i.e. its presence does not cause any kind of delay on the movement of the filling units 111, 211; 122, 222).

The invention claimed is:

1. A filling apparatus (1; 2) for filling containers (101) with fluid products, comprising:

advancing means of said containers along a filling path able to drive said incoming empty containers (101) and said outgoing containers (101) filled with a dose of said fluid product;

a filling area (1'; 2') arranged along said filling path into which said empty containers (1) are filled with said dose of said fluid product, said filling area is provided with safety barriers for the operator and able to prevent access to said filling area (1'; 2') when the filling said containers (1) is performed;

a first filling unit (111; 122) for filling said containers (1) and provided with a plurality of filling members (1111; 1211) able to feed said dose of said fluid product into corresponding containers (1);

a second filling unit (211; 222) for filling said containers (1) and provided with a plurality of filling members (1122, 1222) able to feed said dose of said fluid product into corresponding containers (1);

a rest area (1"; 2") arranged outside of said filling path and of said filling area (1'; 2'), said rest area (1"; 2") is accessible to said operator without interrupting the filling of said containers (1); and actuating means adapted to reciprocally drive said first (111; 122) and said second (211; 222) filling unit from an operating condition to a rest condition;

wherein said first (111; 122) and second (211; 222) filling unit are able to feed said doses of fluid product along said filling path in said filling area (10'; 20');

wherein in said operating condition one of said first (111; 122) and said second (211; 222) filling unit is arranged in said filling area (1'; 2') and able to be in fluid communication with said containers (1) to be filled; and wherein in said rest condition the other between said first (111; 122) and second (211; 222) filling unit is arranged in said rest area (1"; 2") accessible to said operator without interrupting the filling of said containers (1) in said filling area (1');

said apparatus (1; 2) is characterized in that:

said actuating means comprise a support structure rotatable about a vertical axis of rotation;

said first (111; 122) and second (211; 222) filling unit are arranged on said support structure so that the movement between said operating position and said rest position is determined by the rotation of said support structure;

said support structure comprises a partition wall between said rest (1') and said filling (2') areas; and said first (111; 122) and said second (211; 222) filling unit are arranged on opposing surfaces of said partition wall.

2. The filling apparatus (10; 20) for filling containers (1) according to claim 1, comprising:

a first tank of said fluid product;

first feeding means of said fluid product from said first tank to said first (111; 122) and said second (211; 220) filling unit; and wherein said feeding means are operatively connected to said actuating means to place said first tank in fluid communication with said filling unit (111, 122; 211; 220) arranged in said operating condition.

3. The filling apparatus (10; 20) for filling containers (1) according to claim 1, comprising:

a first tank of said fluid product;

first feeding means of said fluid product from said first tank to said first (111) filling unit;

a second tank of said fluid product;

second feeding means of said fluid product from said second tank to said second (211) filling unit; and wherein said feeding means are operatively connected to said actuating means to place said first or said second tank in fluid communication respectively with said first (111) or said second (211) filling unit when arranged in said operating condition.

4. The filling apparatus (10; 20) for filling containers (1) according to claim 1, comprising:

a stock of a cleaning product;

cleaning means, operatively connected to said stock of said cleaning product; and wherein said cleaning means are operatively connected to said actuating means to place in fluid communication said stock of said cleaning product respectively with said first (111; 122) or said second (211; 222) filling unit when arranged in said rest condition.

5. The filling apparatus (10) for filling containers (1) according to claim 1, wherein said advancing means comprise at least a conveyor (410) closed in a loop on first driving means; wherein said first (111) and second (211) filling unit when in said operating condition are driven parallel to said conveyor (410) respectively by a first and a second actuator device.

6. The filling apparatus (20) for filling containers (1) according to claim 1, wherein each of said first (122) and second (222) filling unit is formed by a conveyor rotatable about a vertical axis of rotation and provided with said plurality of filling members (1122, 1222); and wherein in said operating condition said first (122) and second (222) filling unit define part of said filling path.

7. Method for filling containers (1) with fluid products, comprising the steps of:

advancing said containers along a filling path by way of advancing means able to drive incoming empty containers (101) and outgoing containers (101) filled with a dose of said fluid product;

filling said empty container with a dose of said fluid product in a filling area (1'; 2') arranged along said filling path by way of a first (111; 122) or a second (211; 222) filling unit respectively provided with a plurality of filling members (1111, 1211; 1122, 1222), said filling area is provided with safety barriers for the operator so that access to said filling area (1'; 2') during said filling step is prevented; and reciprocally moving said first (111; 122) and second (211; 222) filling unit by way of actuating means from an operating condition to a rest condition; wherein in said operating condition one of said first (111; 122) and said second (211; 222) filling unit is arranged in said filling area (1'; 2') and able to be in fluid communication with said containers (1) to be filled, implementing said step of filling said containers; and wherein in said rest condition the other between said first (111; 122) and second (211; 222) filling unit is arranged in a rest area (1"; 2") outside of said filling path and of said filling area (1'; 2'), said rest area (1"; 2") is accessible to said operator without interrupting said step of filling said containers (1) in said filling area;

said method is characterized in that:

said actuating means comprise a support structure rotatable about a vertical axis of rotation;

said first (111; 122) and second (211; 222) filling unit are arranged on said support structure so that the movement between said operating position and said rest position is determined by the rotation of said support structure;

said support structure comprises a partition wall between said rest (1') and said filling (2') areas; and said first (111; 122) and said second (211; 222) filling unit are arranged on opposing surfaces of said partition wall.

* * * * *